US007971292B1

(12) United States Patent
Sithian

(10) Patent No.: US 7,971,292 B1
(45) Date of Patent: Jul. 5, 2011

(54) POCKETED BEDSHEET, SYSTEM AND METHOD

(76) Inventor: Nedunchezian Sithian, Staten Island, NY (US)

( * ) Notice: Subject to any disclaimer, the term of this patent is extended or adjusted under 35 U.S.C. 154(b) by 0 days.

(21) Appl. No.: 12/763,462

(22) Filed: Apr. 20, 2010

(51) Int. Cl.
*A47G 9/02* (2006.01)
*A47C 20/00* (2006.01)

(52) U.S. Cl. ..... 5/485; 5/648; 5/630; 5/632

(58) Field of Classification Search ..... 5/630, 632, 5/648, 691, 485, 490, 731, 734
See application file for complete search history.

(56) References Cited

U.S. PATENT DOCUMENTS 1,045,228 A * 11/1912 Weltmer ..... 5/500
3,148,387 A * 9/1964 Sarnie, Jr. et al. ..... 5/632
3,638,251 A * 2/1972 Weiss ..... 5/485
3,800,340 A * 4/1974 Valentine ..... 5/485
4,014,055 A 3/1977 Torres
4,574,412 A * 3/1986 Smith ..... 5/632
4,791,687 A * 12/1988 Iwase ..... 5/708
4,873,734 A 10/1989 Pollard
4,914,767 A 4/1990 Balicki et al.
5,097,847 A * 3/1992 Mikhail et al. ..... 128/849
5,173,979 A * 12/1992 Nennhaus ..... 5/648
5,438,719 A * 8/1995 Anthony ..... 5/485
5,644,807 A 7/1997 Battistella
5,948,013 A 9/1999 Swezey et al.
5,991,946 A 11/1999 Harris
6,148,458 A 11/2000 Hires
6,292,964 B1 9/2001 Rose et al.
6,415,466 B1 * 7/2002 Laiso ..... 5/485
7,140,056 B2 11/2006 Deering
7,444,699 B2 11/2008 Hense
7,584,515 B2 9/2009 Jones et al.

* cited by examiner

*Primary Examiner* — Michael Trettel
(74) *Attorney, Agent, or Firm* — Gordon & Jacobson, PC

(57) ABSTRACT

A bedsheet, a system, and a method for use thereof for elevating at least one leg or heel of the patient lying on a mattress is disclosed. The bedsheet has a plurality of overlapping longitudinally spaced pockets into which a pillow is insertable. The orientation and configuration of the pockets of the bedsheet allows for insertion of the pillow into the bedsheet at a desired location with minimal interruption to or movement of the patient, and holds the inserted pillow in a relatively fixed position relative to the bedsheet. The system includes the bedsheet and the pillow. The method includes placing the bedsheet on the mattress, inserting the pillow into one of the pockets of the bedsheet to create an elevated portion of the bedsheet, and positioning the leg or heel of the patient on top of the elevated portion of the bedsheet.

20 Claims, 4 Drawing Sheets

POCKETED BEDSHEET, SYSTEM AND METHOD

BACKGROUND OF THE INVENTION

1. Field of the Invention

This invention relates broadly to bedsheets having pockets. More particularly, the invention relates to bedsheets having pockets for receiving pillows, and methods of using the same.

2. State of the Art

In settings such as rehabilitation centers, hospitals, and nursing homes, patients are frequently bedridden. Bedridden patients, the elderly, and anyone else whose mobility is highly limited often develop foot and leg ulcers due to poor blood circulation resulting from narrowed arteries and damage to small blood vessels caused by diseases such as long-standing diabetes, and by the sheer weight of the legs. Ulcers are breaks in the layers of the skin that fail to heal due to poor circulation and regeneration of tissue, and often progress in these patients. Foot and leg ulcers can often lead to gangrene and can ultimately result in amputation. Treating the heel and leg ulcers in these patients can cost millions of dollars.

Elevating the leg of a patient can help to prevent the beginning of foot and leg ulcers, and for venous diseases, can assist the patient's body in healing an injured or weakened area by improving circulation. Doctors and nurses often utilize pillows not only to elevate the patient's head, but also to provide support to and elevate an injured or weakened area of the patient's body.

SUMMARY OF THE INVENTION

The present invention provides a bedsheet, a system and a method for use thereof for elevating at least one leg or heel of the patient lying on a mattress. The bedsheet has a plurality of overlapping longitudinally spaced pockets into which a pillow is insertable. The bedsheet allows for insertion of the pillow into the bedsheet with minimal interruption to or movement of the patient, and holds the inserted pillow in a relatively fixed position relative to the bedsheet. The system includes the bedsheet and the pillow.

The bedsheet includes a first sheet having a top surface, a bottom surface opposite the top surface, an upper end, a lower end, and a length between the upper and lower ends, a second sheet attached to the top surface of the first sheet and overlapping the first sheet, and a third sheet attached to the top surface of the first sheet and overlapping the first and second sheets. The first and second sheets of the bedsheet together define a first pocket which opens to receive the pillow, and the first, second, and third sheets together define a second pocket which overlaps the first pocket and also opens to receive the pillow.

When the bedsheet is placed on a mattress, the bottom surface of the first sheet faces the mattress, the upper end of the first sheet is disposed at or adjacent a head of the patient, and the lower end of said first sheet is disposed at or adjacent a foot of the patient. In a first configuration, a pillow is disposed inside the first pocket of the bedsheet, and the first pocket has an open end which is longitudinally situated between the closed end of the first pocket and the lower end of the first sheet. The first pocket also has a closed end opposite its open end. In this manner, the pillow is insertable into and is removable from the first pocket though the open end of the first pocket with minimal disruption to or movement of the patient. With the pillow inside the first pocket, the first pocket provides a first elevated section for elevating the patient's foot or leg. In addition, the orientation of the first pocket prevents the patient from kicking or otherwise moving the pillow from its position within the first pocket.

In the second configuration, the pillow is disposed inside the second pocket of the bedsheet, and the second pocket has an open end which is longitudinally situated between the closed end of the first pocket and the open end of the first pocket. The second pocket also has a closed end opposite its open end. In this manner, the pillow is insertable into and is removable from the second pocket though the open end of the second pocket with minimal disruption to the patient. With the pillow inside the second pocket, the second pocket provides a second elevated section for elevating the patient's foot or leg, and also prevents the patient from kicking or otherwise moving the pillow from its position within the second pocket.

In this manner, the pillow may be positioned and relatively fixed in the bedsheet in different locations relative to the patient depending on the patient's height, the patient's positioning on the mattress, and depending on the specific portion of the patient's leg or foot for which elevation is needed or desired.

In the preferred embodiment, the bedsheet includes a fourth sheet which is attached to the top surface of the first sheet and overlaps the first, second, and third sheets. The first, third, and fourth sheets together define an expandable third pocket which overlaps the first and second pockets. The bedsheet is thus preferably configurable to a third configuration with the pillow disposed inside the third pocket of the bedsheet. In the third configuration, the third pocket has an open end which is longitudinally situated between the closed end of the second pocket and the open end of the second pocket. The third pocket also has a closed end opposite its open end. In this manner, the pillow is insertable into is removable from the third pocket though the open end of the third pocket with minimal disruption to the patient. With the pillow inside the third pocket, the third pocket provides a third elevated section for elevating the patient's foot or leg, and also prevents the patient from kicking or otherwise moving the pillow from its position within the third pocket.

The method of the invention includes placing the bedsheet of the system on a mattress with the bottom side facing the mattress, the upper end at or adjacent the position on the mattress where the head of the patient will be located, and the lower end at or adjacent where the heel of the patient will be located. The pillow of the system is then inserted into one of the pockets of the bedsheet either prior to or after the patient lays down on the mattress. The leg or heel of the patient is then positioned on top of the elevated pocket into which the pillow has been placed. In this manner, the leg or heel of the patient is elevated, thereby assisting circulation and preventing or decreasing pressure in at least a portion of the leg or heel of the patient and helping to prevent ulcers from forming in the leg or heel of the patient.

According to one aspect of the invention, the first sheet includes two oppositely disposed seams extending longitudinally along a portion of the length of the first sheet. The second, third, and fourth sheets are preferably all attached to the two oppositely disposed and longitudinally extending seams.

According to another aspect of the invention, at least one fastener is provided which is preferably positioned within at least one of the pockets for fastening the pillow to one of the first and second pockets.

According to yet another aspect of the invention, the pillow is inflatable before or after being placed inside one of the pockets.

Additional objects and advantages of the invention will become apparent to those skilled in the art upon reference to the detailed description taken in conjunction with the provided figures.

DETAILED DESCRIPTION OF THE PREFERRED EMBODIMENTS

Turning now to FIGS. 1-4B, a system 10 is shown for use with a patient (not shown) lying on a mattress 11 to elevate at least one leg or heel of the patient. The system 10 includes a bedsheet 12 which fits to and at least partially covers the mattress 11, and a pillow 14 which is insertable into one or more pockets (further discussed below) in the bedsheet 12 at specific locations along the bedsheet 12.

Figure 1:
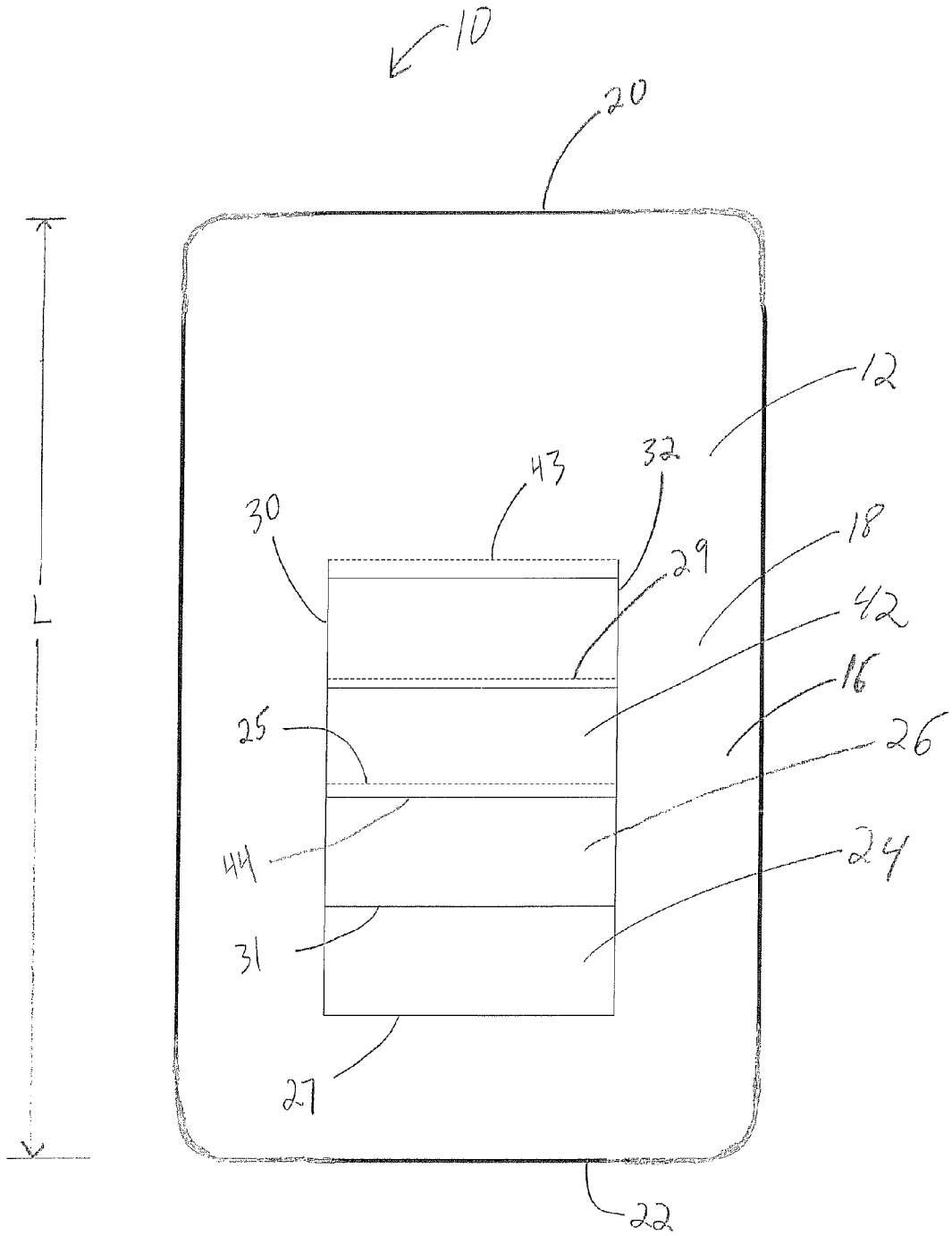
FIG. 1 is a top view of the bedsheet of the invention.
Figure 2A:
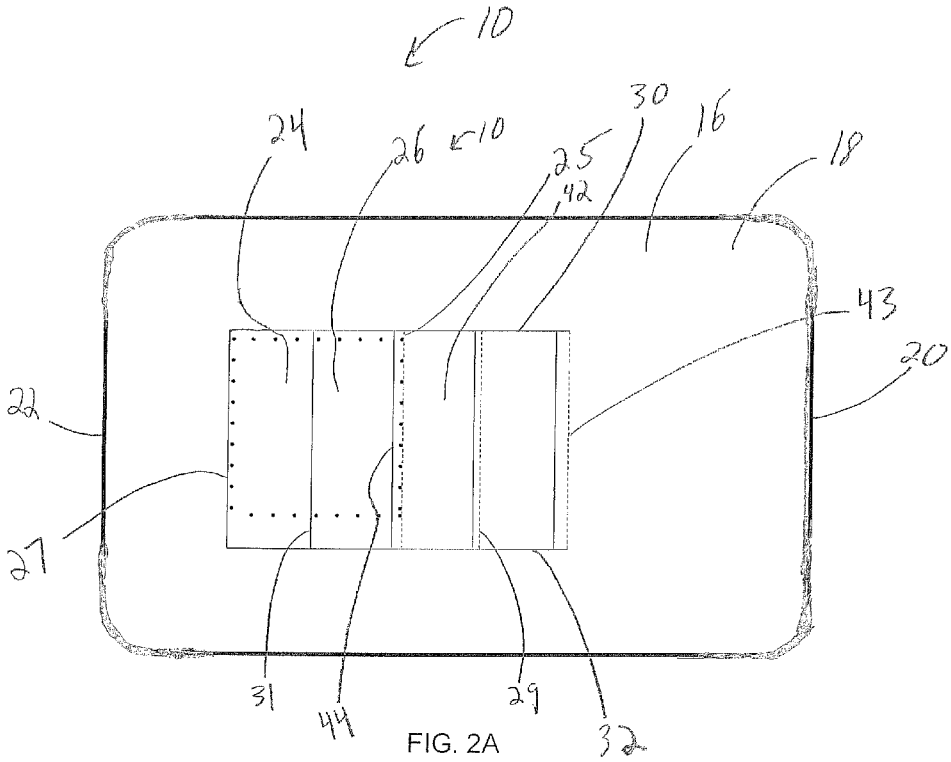
FIG. 2A is a top view of the bedsheet of the invention with the pillow disposed inside the first pocket of the bedsheet.
Figure 2B:
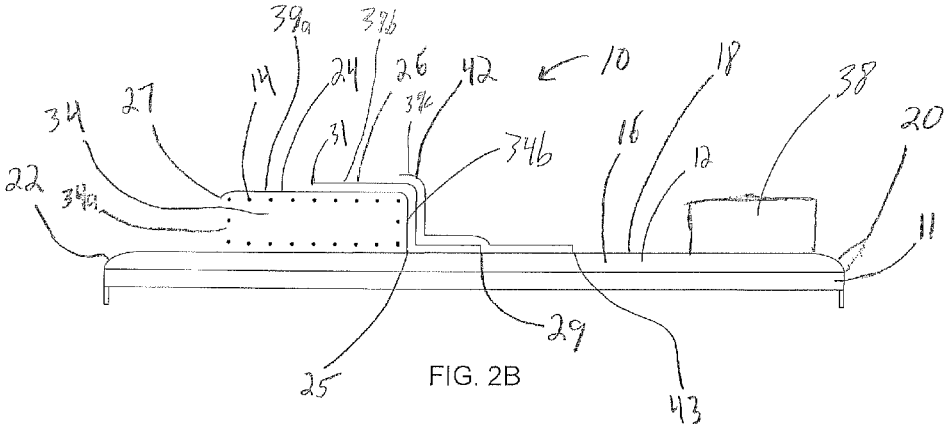
FIG. 2B is a side view of the bedsheet and pillow of FIG. 2A.

Turning to FIGS. 1-2B, the bedsheet 12 includes a first sheet 16 which is fitted to cover the top of the mattress 11 and at least a portion of the sides of the mattress 11. The first sheet 16 has a top surface 18, a bottom surface (hidden) opposite the top surface 18 which faces the mattress 11, an upper end 20, a lower end 22, and a length (L) between the upper and lower ends 20, 22. The bedsheet 12 also includes a second sheet 24 and a third sheet 26 attached thereto. The second sheet 24 is attached to the first sheet 16 at one end 25 (e.g., by stitching), overlaps a portion of the top surface 18 of the first sheet 16, and extends to an opposite end 27. The third sheet 26 is attached to the first sheet 16 at one end 29 (e.g., by stitching), overlaps portions of the top surfaces of the first and second sheets 16, 24, and extends to an opposite end 31.

Two oppositely disposed seams 30, 32 are preferably provided which are attached to the top surface 18 of the first sheet 16 and extend longitudinally along a portion of the length L of the first sheet 16. The second and third sheets 24, 26 are both attached to the first sheet at the seams 30, 32. Attachment of the second and third sheets 24, 26 to the first sheet 16 is preferably accomplished using stitching or any other suitable means known in the art.

It will be appreciated that the first and second sheets 16, 24 of the bedsheet 12 together define an expandable first pocket 34 (FIG. 2B) for receiving the pillow 14, and that the first, second, and third sheets 16, 24, 26 together define an expandable second pocket 36 (FIG. 3B) which overlaps the first pocket 34 and which may also receive the pillow 14. For example, as shown in FIG. 3B, the top surfaces of the first and second sheets 16, 24 and the bottom surface of the third sheet 26 together define the second pocket 36.

Turning back to FIG. 2B, the system 10 is shown in a first configuration. In the first configuration, the bedsheet 12 and pillow 14 are disposed on the mattress 11 with the bottom surface (hidden) of the first sheet 16 facing the mattress 11, covering the top portion of the mattress 11 and at least a portion of the sides of the mattress 11. The upper end 20 of the first sheet 16 is positioned in the approximate location where the patient's head will lie. An additional (free-standing) pillow 38 for supporting the patient's head may be provided at or adjacent the upper end 20 of the bedsheet 12. The lower end 22 of the first sheet 16 is positioned in the approximate location where the patient's foot (not shown) will lie. The pillow 14 is disposed inside the first pocket 34 of the bedsheet 12.

The first pocket 34 has an open end 34*a* and a closed end 34*b*. It will be appreciated that the closed end 34*b* of the pocket 34 is formed from the attachment of the second sheet 24 to the first sheet 16 at the end 25. The open end 34*a* of the first pocket 34 is longitudinally situated between the closed end 34*b* of the first pocket 34 and the lower end 22 of the first sheet 16, and receives the pillow 14. In this manner, the pillow 14 may be inserted into and removed from the first pocket 34 through its open end 34*a* without making the patient elevate or otherwise move his or her torso relative to the bedsheet 12 to insert the pillow 14.

With the pillow 14 inside the first pocket 34, the first, second, and third pockets 34, 36, 42 provide first elevated surfaces 39*a*, 39*b*, 39*c* for elevating the patient's foot/feet or leg(s). In addition, the orientation of the first pocket 34 with the open end 34*a* facing the lower end 22 and the remainder of the pocket 34 sealed (on account of the attachment of the second sheet 24 to the first sheet 16 at the closed end 25 and at the two seams 30, 32), movement of the patient's legs relative to the bedsheet 12 will generally not cause the pillow 14 to move or exit from the pocket 34 and will not cause the patient's legs and feet to enter the first pocket 34 or kick the pillow 14. The patient will not even contact the pillow 14 unless the pillow 14 is only partially inserted into the pocket 34. It will be appreciated that this aspect of the invention allows the patient to stretch out his or her legs in bed while maintaining the longitudinal position of the pillow 14 relative to the bedsheet 12, and while maintaining the specific longitudinal location along the length L of the bedsheet 12 at which the bedsheet 12 is elevated. The patient can thus get out of bed and use the bathroom, stretch out, etc. Upon getting back into the bed, the patient can simply resume a preferred position of lying backward on the bedsheet 12 and place his or her leg or foot back over the elevated surfaces 39*a*, 39*b*, 39*c*. It will be appreciated that the elevated surfaces 39*a*, 39*b*, 39*c* will be at roughly the same elevation as the second and third pockets 36, 46 are collapsed. The thicknesses of the third and fourth sheets 26, 42 shown in FIG. 2B are enlarged for illustrative purposes.

Figure 3A:
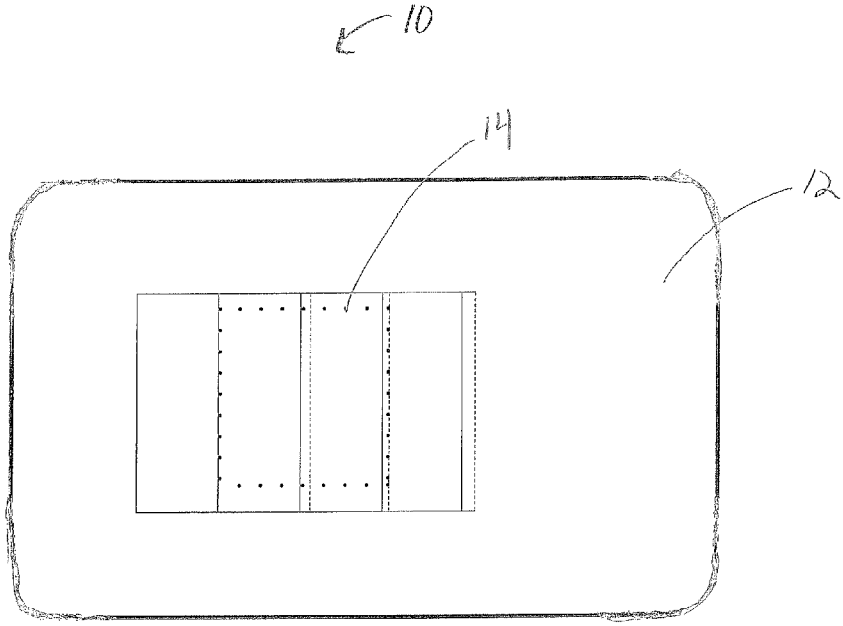
FIG. 3A is a top view of the bedsheet of the invention with the pillow disposed inside the second pocket of the bedsheet.
Figure 3B:
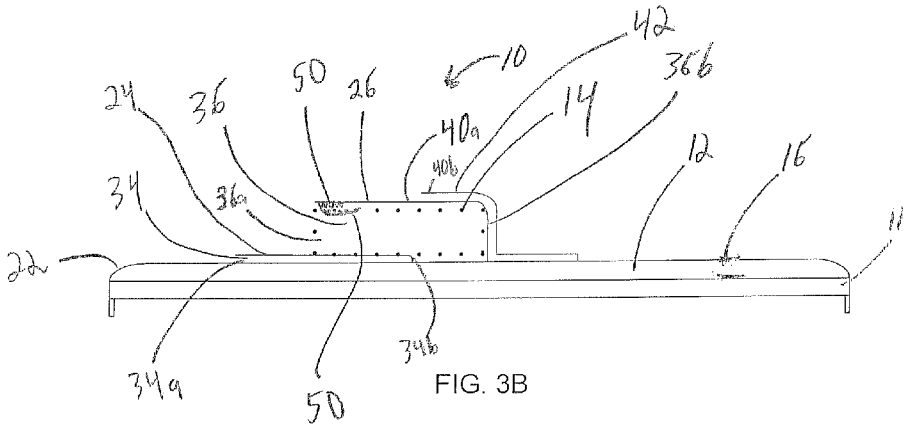
FIG. 3B is a side view of the bedsheet and pillow of FIG. 3A.

Turning to FIGS. 3A, 3B, the bedsheet 12 and pillow 14 are shown in a second configuration. The second configuration is the same as the first configuration except that the pillow 14 is disposed inside the second pocket 36 of the bedsheet 12, the second pocket 36 has opened to receive the pillow 14, and the first pocket 34 is collapsed. The second pocket 36 has an open end 36*a* which is longitudinally situated between the closed end 34*b* of the first pocket 34 and the open end 34*a* of the first pocket 34. The second pocket 36 also has a closed end 36*b* opposite its open end 36*a*. In this manner, the pillow is inserted into and may be removed from the second pocket 36 though its open end 36*a* with minimal disruption to the patient as discussed above with respect to the first pocket 34. With the pillow 14 inside the second pocket 36, the second and third pockets 36, 46 provide second elevated surfaces 40*a*, 40*b* (at approximately the same elevation fourth sheet 42) for elevating the patient's foot or leg, and also prevents the patient from kicking or otherwise moving the pillow 14 as the patient's foot or leg rests on top of the second elevated surface 40 of the second pocket 36 and does not contact the pillow 14 or enter the second pocket 36.

In this manner, the pillow may be positioned and relatively fixed in the bedsheet 12 in different locations relative to the patient depending on the patient's height, the patient's positioning on the mattress 11, and depending on the specific portion of the patient's leg or foot for which elevation is needed.

Figure 4A:
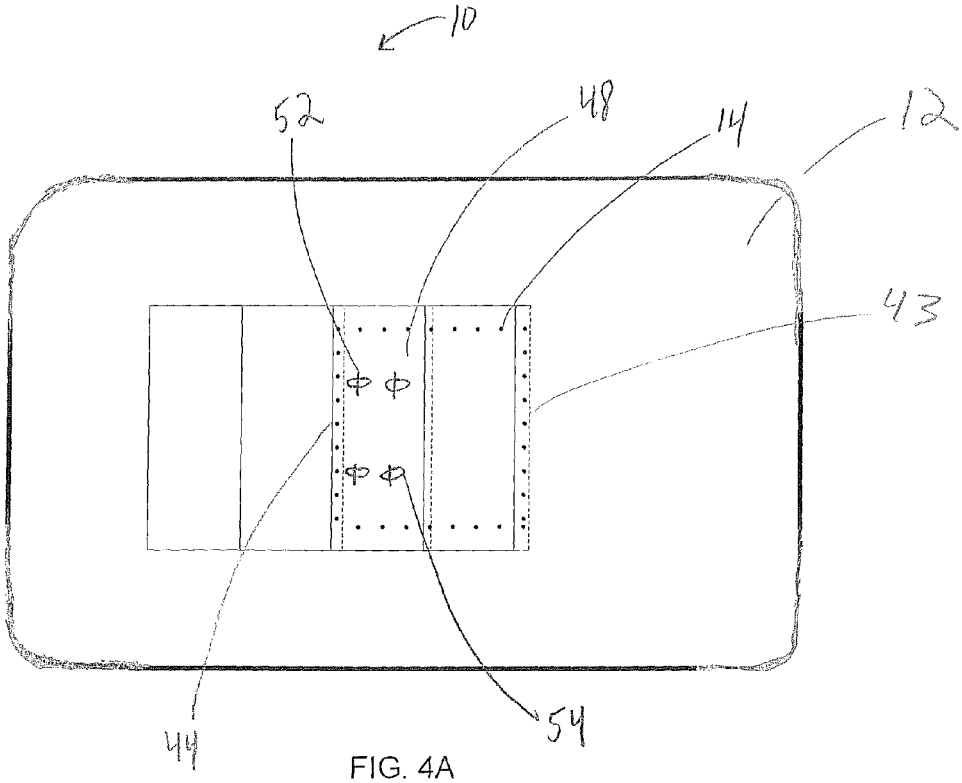
FIG. 4A is a top view of the bedsheet of the invention with the pillow disposed inside the third pocket of the bedsheet.
Figure 4B:
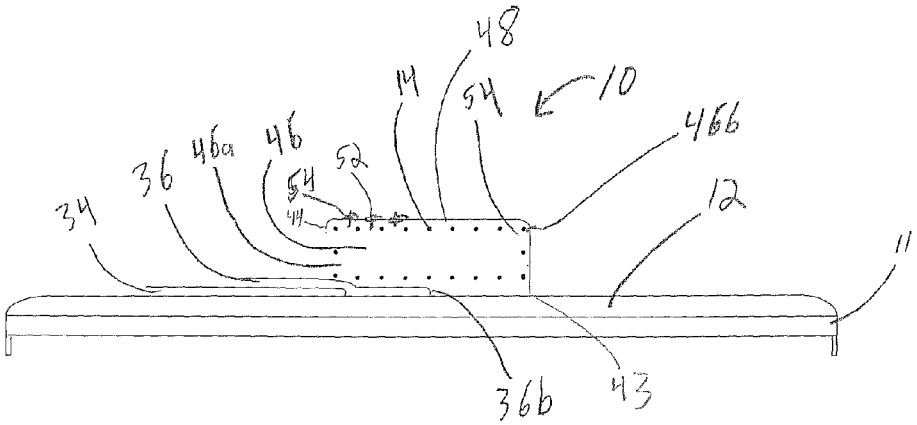
FIG. 4B is a side view of the bedsheet and pillow of FIG. 4A.

In the preferred embodiment, the bedsheet includes a fourth sheet 42 which is attached to the first sheet 16 at one end 43 (e.g., by stitching), overlaps portions of the first and third sheets 16, 26 (also extending above a portion of the second sheet 24 which is covered at that location by a portion of the third sheet 26), and extends to an opposite end 44. Turning to FIGS. 4A, 4B, the bedsheet 12 and pillow 14 are shown in a third configuration. As shown, the first, third, and fourth sheets 16, 26, 42 together define an expandable third pocket 46 which overlaps the first and second pockets 34, 36. The third configuration is the same as the first and second configurations except that the pillow 14 is disposed inside the third pocket 46 of the bedsheet 12, the third pocket 46 has opened to accommodate the pillow 14, and the first and second pockets 34, 36 are collapsed. The third pocket 46 has an open end 46*a* which is longitudinally situated between the closed end 36*b* of the second pocket 36 and the open end 36*a* of the second pocket 36. The third pocket 46 also has a closed end 46*b* opposite its open end 46*a*.

In this manner, the pillow 14 is inserted into and may be removed from the third pocket 46 though its open end 46*a* with minimal disruption to the patient. With the pillow 14 inside the third pocket 46, the third pocket 46 provides a third elevated surface 48 for elevating the patient's foot or leg, and also prevents the patient from kicking or otherwise moving the pillow 14 as the patient's foot or leg rests on top of the third elevated surface 48 of the third pocket 46 and does not contact the pillow 14 or enter the third pocket 46. It will be appreciated that the third pocket 46 may be disposed under the upper leg of the patient.

While it is contemplated that the pockets 34, 36, 46 of the bedsheet 12 may be sized to create a snug or press fit when the pillow 14 is inserted therein so as to hold the pillow in place, various securement devices may alternatively or additionally be used to secure the pillow 14 within a given pocket. By way of one example, as shown in FIG. 3B, hooks and fastener strips 50 or any other suitable fastener may be provided to the inside of one or more pockets and/or to the pillow 14 to secure the pillow 14 to the bedsheet 12 within one of the pockets 34, 36, 46. By way of another example, as shown in FIGS. 4A, 4B, the third elevated surface 48 of the third pocket 46 may define button slots 52 for receiving buttons 54 attached to the pillow 14 once the pillow 14 is inserted into the third pocket 46. The first and second pockets 34, 36 could similarly define slots for receiving pillow buttons. The pillow 14 may be an inflatable pillow which can be inflated prior to or subsequent to its insertion into one of the pockets 34, 36, 46.

It will be appreciated that the general method of the invention includes placing the bedsheet 12 of the system 10 on a mattress 11 with the bottom side of the bedsheet 12 facing the mattress 11, the upper end 20 at or adjacent the position on the mattress where the head of the patient will be located, and the lower end 22 at or adjacent where the heel of the patient will be located. The pillow 14 of the system 10 is then inserted into one of the pockets 34, 36, 46 of the bedsheet 12 either prior to or after the patient lays down on the mattress 11. The leg or heel of the patient is then positioned on top of the expanded pocket into which the pillow 14 has been placed. In this manner, the leg or heel of the patient is elevated, thereby assisting circulation in the leg or heel of a patient (e.g., one with venous disease), and helping to prevent the initial formation of ulcers in the leg or heel of a patient.

In one embodiment, the second, third and fourth sheets 24, 26, 42 are longitudinally offset from each other by ten inches (e.g., overlapping and attached to the bedsheet 12 at ten inch intervals). This permits insertion of the pillow 14 at ten inch intervals along the first sheet 16. In another embodiment, the second, third and fourth sheets are longitudinally offset from each other by eight inch intervals (e.g., overlapping and attached to the bedsheet 12 at eight inch intervals). This permits insertion of the pillow 14 at eight inch intervals along the first sheet 16. In another embodiment, the second, third and fourth sheets are longitudinally offset from each other by six inch intervals (e.g., overlapping and attached to the bedsheet 12 at six inch intervals). This permits insertion of the pillow 14 at six inch intervals along the first sheet 16. In another embodiment, a fifth sheet is provided, which provides a fourth pillow pocket.

According to one aspect of the invention, the first sheet is a fitted sheet (e.g., with elastic elements at the corners) which is particularly sized for hospital-type beds which are commonly used in nursing homes, rehabilitation centers, and hospitals. According to another aspect of the invention the first sheet is a fitted sheet which is sized as a twin, full, queen, or king sized sheet. According to another aspect of the invention, the first sheet may be a flat sheet which can be placed and "made" onto the mattress in manners well-known in the art.

There have been described and illustrated herein several embodiments of a pocketed bedsheet and pillow system and a method of assisting circulation and preventing ulcers from forming in a patient. While particular embodiments of the invention have been described, it is not intended that the invention be limited thereto, as it is intended that the invention be as broad in scope as the art will allow and that the specification be read likewise. Thus, while particular shapes, sizes, and configurations of sheets, pockets, mattresses, and seams have been disclosed, it will be appreciated that other shapes, sizes, and configurations may be used as well. In addition, while particular types of fasteners have been disclosed, it will be understood that other types of fasteners may be utilized. Also, while a bedsheet having three pockets is preferred, it will be recognized that the number of pockets utilized may be less than three or greater than three. Furthermore, while a method for utilizing the system has been disclosed with respect to a patient in certain settings has been disclosed, it will be understood that the method can similarly be utilized by a person in a dwelling such as a home or other setting. It will therefore be appreciated by those skilled in the art that yet other modifications could be made to the provided invention without deviating from its spirit and scope as claimed.

What is claimed is:

1. A bedsheet for use with a mattress and a pillow, comprising:

a first sheet having a top surface, a bottom surface opposite said top surface, an upper end, a lower end, and a length between said upper and lower ends;

a second sheet attached to said first sheet and extending over a portion of said top surface of said first sheet, said first and second sheets defining a first pocket for receiving the pillow, said first pocket having an open end through which the pillow is insertable, and an opposite closed end, said open end of said first pocket longitudinally situated between said closed end of said first pocket and said lower end of said first sheet;

a third sheet attached to said first sheet and extending over a portion of said top surface of said first sheet, said first, second, and third sheets together defining a second pocket for receiving the pillow, said second pocket overlapping said first pocket and having an open end through which the pillow is insertable, and an opposite closed end, said open end of said second pocket disposed between said closed end of said second pocket and said open end of said first pocket.

2. A bedsheet according to claim 1, wherein:

said first sheet includes two oppositely disposed seams attached to said top surface of said first sheet and extending longitudinally along a portion of the length of said first sheet, and said second and third sheets are both attached to said two oppositely disposed and longitudinally extending seams.

3. A bedsheet according to claim 1, further comprising:

a fourth sheet attached to said first sheet and extending over a portion of said top surface of said first sheet, said first, third, and fourth sheets together defining an expandable third pocket for receiving the pillow, said third pocket overlapping said first and second pockets and having an open end through which the pillow is insertable, and an opposite closed end, said open end of said third pocket disposed between said closed end of said second pocket and said open end of said second pocket.

4. A bedsheet according to claim 3, wherein:

said first sheet includes two oppositely disposed seams attached to said top surface of said first sheet and extending longitudinally along a portion of the length of said first sheet, and said second, third, and fourth sheets are all attached to said two oppositely disposed and longitudinally extending seams.

5. A bedsheet according to claim 1, wherein:

said first sheet is a fitted sheet which elastically fits to the mattress with said bottom surface of said first sheet facing the mattress.

6. A bedsheet according to claim 1, wherein:

each of said first and second pockets substantially limits movement of the pillow when the pillow is disposed therein.

7. A bedsheet according to claim 1, further comprising:

at least one fastener positioned on or within one of said first and second pockets for fastening said pillow to said one of said first and second pockets.

8. A bedsheet according to claim 7, wherein:

said at least one fastener includes at least one of a hook and loop fastener, a zipper, and a button.

9. A system for use on a mattress to assist circulation in at least one leg or heel of a patient lying on the mattress to help prevent ulcers from forming in the leg or heel of the patient, the system comprising:

a pillow; and a bedsheet including a first sheet having a top surface, a bottom surface opposite said top surface, an upper end, a lower end, and a length between said upper and lower ends, a second sheet attached to said first sheet and extending over a portion of said top surface of said first sheet, said first and second sheets defining a first pocket for receiving a pillow, said first pocket having an open end through which said pillow is insertable, and an opposite closed end, said open end of said first pocket longitudinally situated between said closed end of said first pocket and said lower end of said first sheet, and a third sheet attached to said first sheet and extending over a portion of said top surface of said first sheet, said first, second, and third sheets together defining an expandable second pocket for receiving said pillow, said second pocket overlapping said first pocket and having an open end through which said pillow is insertable, and an opposite closed end, said open end of said second pocket disposed between said closed end of said second pocket and said open end of said first pocket, wherein, said system is configurable into first and second configurations on the mattress in which said bottom surface of said first sheet faces said mattress, said upper end of said first sheet is disposed at or adjacent a head of the patient, and said lower end of said first sheet is disposed at or adjacent a foot of the patient, and wherein, in said first configuration, said pillow is disposed within said first pocket, and said first pocket provides a first elevated surface relative to the head of the patient, and in said second configuration, said pillow is disposed within said second pocket, and said second pocket provides a second elevated surface relative to the head of the patient.

10. A system according to claim 9, wherein:

said bedsheet includes a fourth sheet attached to said first sheet and extending over a portion of said top surface of said first sheet, said first, third, and fourth sheets together defining a third pocket for receiving said pillow, said third pocket overlapping said first and second pockets and having an open end through which said pillow is insertable, and an opposite closed end, and said open end of said third pocket is disposed between said closed end of said second pocket and said open end of said second pocket.

11. A system according to claim 10, wherein:

said system is configurable to a third configuration in which said first sheet of said bedsheet is disposed on the mattress with said bottom surface of said first sheet facing the mattress, said upper end of said first sheet is disposed at or adjacent the head of the patient, and said lower end of said first sheet is disposed at or adjacent the foot of the patient, on said mattress with said bottom surface of said first sheet facing said mattress and said pillow disposed inside said third pocket, and wherein, in said third configuration, said pillow is disposed within said third pocket, and said third pocket provides a third elevated surface relative to the head of the patient.

12. A system according to claim 11, wherein:

said first, second, and third elevated surfaces extend above different longitudinal sections of said first sheet in said respective first, second, and third configurations.

13. A system according to claim 9, further comprising:

at least one fastener positioned within one of said first and second pockets for fastening said pillow to said one of said first and second pockets.

14. A system according to claim 13, wherein:

said at least one fastener includes at least one of a hook and loop fastener, a zipper, and a button.

15. A system according to claim 9, wherein:

said first sheet includes two oppositely disposed seams attached to said top surface of said first sheet and extending longitudinally along a portion of the length of said first sheet, and said second and third sheets are both attached to said two oppositely disposed and longitudinally extending seams.

16. A method for assisting circulation in at least one leg or heel of a patient lying on a mattress to help prevent ulcers from forming in the leg or heel of the patient, the method comprising:

providing a bedsheet which has a top side, a bottom side, an upper end, and a lower end, and defines first and second overlapping pockets;

placing the bedsheet on the mattress with the bottom side facing the mattress, the upper end at or adjacent the head of the patient, and the lower end at or adjacent the heel of the patient;

inserting a pillow into one of the first and second pockets of the bedsheet; and positioning the leg of the patient on top of the one of the first and second pockets whereby the leg is elevated relative to the head of the patient, wherein, each of the first and second pockets has an open end and a closed end, and the open ends of the first and second pockets are closer to the heel of the patient than the closed ends of the first and second pockets.

17. A method according to claim 16, wherein:

the pillow is inserted through the open end of the one of the first and second pockets in a direction which is toward the head of the patient.

18. A method according to claim 16, wherein:

the bedsheet defines a third pocket overlapping the first and second pockets for receiving the pillow.

19. A method according to claim 16, wherein:

the bedsheet includes at least one fastener for fastening the pillow inside one of the pockets.

20. A method according to claim 16, wherein:

the pillow is inflated after being inserted into the one of the first and second pockets.

* * * * *